United States Patent [19]

Lewis et al.

[11] Patent Number: 4,705,741

[45] Date of Patent: Nov. 10, 1987

[54] PROCESSLESS COLOR IMAGING AND FILM THEREFOR

[75] Inventors: David F. Lewis, Monroe, Conn.; James R. Kuszewski, Warren, N.J.

[73] Assignee: GAF Corporation, Wayne, N.J.

[21] Appl. No.: 839,391

[22] Filed: Mar. 14, 1986

[51] Int. Cl.[4] ..... G03C 1/727

[52] U.S. Cl. ..... 430/333; 430/344; 430/296

[58] Field of Search ..... 430/296, 333, 334, 344

[56] References Cited

U.S. PATENT DOCUMENTS

| | | | |
|---|---|---|---|
| 2,754,210 | 7/1956 | Elliott | 430/344 |
| 3,501,297 | 3/1970 | Cremeans | 430/338 |
| 3,501,308 | 3/1970 | Adelman | 430/344 |
| 3,560,211 | 2/1971 | Fotland | 430/332 |
| 3,598,583 | 8/1971 | Sprague | 430/344 |
| 4,171,980 | 10/1979 | Ceintrey | 430/344 |
| 4,368,254 | 1/1983 | Vannikov et al. | 430/333 |
| 4,394,439 | 7/1983 | Robillard | 430/344 |

*Primary Examiner*—Won H. Louie

*Attorney, Agent, or Firm*—Marilyn J. Maue; Joshua J. Ward

[57] ABSTRACT

The invention relates to a multilayered image receptive film developed in distinguishable colors by kinetic energy imparted by radiant beam exposure which comprises (a) a first imaging layer composed of an aliphatic, polymeric binder containing from about 40 wt. % to about 70 wt. % of labile halogen, said binder capable of dehydrohalogenation at address points of radiant energy exposure and having dispersed therein a first polyphenylmethane compound capable of forming a first halide salt dye upon generation of hydrogen halide from said binder; (b) a second imaging layer similar to said first imaging layer and contiguously disposed below said first imaging layer, containing a second and distinct polyphenylmethane compound capable of forming a halide salt dye of a color distinguishable from that of said first halide salt dye and (c) a conductive support for layers (a) and (b).

The invention also relates to a process of multi-color imaging by subjecting said film to a plurality of radiant energy exposures at critically distinct beam energies individually modulated in accordance with the thickness of each imaging layer to effect penetration and exposure of the first and second imaging layers separately and to form halide salt dyes of distinguishable colors in said first and second imaging layers at the respective points of beam address.

18 Claims, No Drawings

PROCESSLESS COLOR IMAGING AND FILM THEREFOR

In one aspect the invention relates to a multilayered film containing individually distinguishable leuco base compounds. In another aspect the invention relates to the process whereby imaging of such film is effected in a plurality of distinguishable colors.

PRIOR ART

Monolayered color imaging with leuco base compounds, fixedly positioned in a binder, is known. Generally, the leuco base together with an acid generating activator is dispersed in a binder, and the dispersion is coated on a conductive support. When exposed to radiant energy, such as photon or particle radiation, acid is liberated from the activator and the ensuing reaction between the acid and the leuco base produces an image in a color corresponding to the dye product. The activator is commonly a low molecular weight compound containing labile halogen from which hydrogen halide is liberated as a result of radiant energy exposure. Such a process is described in U.S. Pat. No. 3,560,211. However, such films are subject to damage or deterioration by exposure to heat and light during normal storage since the activator compounds often cause unwanted predevelopment by formation of acid and concomitant reaction of this product with the leuco dye. Also, such films, when used in a high vacuum environment as in the case of electron beam exposure, tend to lose the activator reactants owing to their volatility at reduced pressures and do not develop full image intensity. Such films are not adaptable to multilayer imaging since the amount of volatilized activator is not easily controlled and the removal of activator by-product from lower layers would be extremely difficult and most probably would cause damage to any superimposed imaging layer.

Additionally, the loss of volatile components of the film in the high vacuum environment of an electron beam exposure device is detrimental to the prolonged error free functioning of that device, since these volatile components become adsorbed upon, and contaminate, surfaces inside the electron optical column.

Alternatively, oil soluble amino azo indicator dyes, which change color at a pH between 2–4 have been substituted for the leuco base compounds since such compounds, as are described in U.S. Pat. Nos. 3,370,981 and 3,425,867, have relatively low volatilities. However, these azo compounds require close control of pH in the imaging layer to effect proper color development and often produce unstable conditions, which problems would be multiplied in a system employing several superimposed imaging layers.

Accordingly, it is an object of the present invention to overcome the above disadvantages and to provide a commercially acceptable multilayered imaging film for development in several distinguishable colors by an efficient and commercially feasible process.

Another object of the invention is to provide a multilayered imaging film which is not subject to deterioration upon exposure to moisture, light or heat.

Another object is to provide a multilayered imaging film which minimizes volatilization of components during high vacuum radiant energy exposure and which provides a color stable image.

Yet another object is to provide a process for transducing electrical information into a multicolored visual record.

These and other objects of the invention will become apparent from the following description and disclosure.

THE INVENTION

In accordance with the present invention, there is provided a recording medium having a plurality of superimposed color imaging layers, disposed on a conductive support, which are capable of individual color development at discrete points of address when exposed to a source of radiant energy. The film comprises a first imaging layer composed of a normally solid, aliphatic halogenated polymeric binder capable of dehydrohalogenation in response to energy imparted by a source of radiant energy at a point of impact and having homogeneously dispersed therein a polyphenylmethane leuco base capable of forming a corresponding ionized halide salt dye by interaction with the hydrogen halide generated from the halogenated polymer; a second imaging layer similar to the first imaging layer and contiguously disposed below the first layer, but containing a separate and distinct polyphenylmethane leuco base compound capable of forming a corresponding ionized halide salt dye of a color distinguishable from that which would be developed in the first layer and an electrically conductive support for the above described first and second imaging layers.

The process for color development of the above described film depends on the observance of critical parameters, primarily the use of several distinct and critical beam energies modulated to effect separate penetration and exposure of the first imaging layer and the first and second imaging layers in combination and to cause generation of hydrogen halide from said halogenated polymer in said layers at the point of beam impact with simultaneous formation of the halide salt dyes having distinguishable colors. The beam energies are controlled in accordance with the thickness of each individual imaging layer, such that when a surface imaging layer of the present film is employed in a thickness of between about 0.5 and about 10 micrometers, preferably between about 1 and about 3 micrometers, a corresponding electron beam energy of from 5 KeV to 25 Kev, preferably from about 10 KeV to about 15 KeV, at an exposure dosage of between about $1\times10^{-8}$ and about $1\times10^{-2}$ C/cm$^2$ is employed. The second underlying imaging layer, usually having a thickness of between about 0.5 and about 10 micrometers, requires a higher beam energy of between 20 KeV and 50 KeV, preferably between about 20 KeV and about 30 KeV, at a similar range of exposure dosage. These parameters must be strictly observed for color stable, multicolor development of the present film. Since each electron beam possesses a small and finite penetrating power, the beam energies and layer thicknesses utilized in the present invention must be closely controlled within the above ranges. Such control is obtained by the degree of acceleration of electrons in the electric field between the anode and the cathode of an electron beam apparatus. Failure to apply the proper electron beam energy cannot be corrected by adjusting the degree of film exposure since it is of primary importance that the beam penetrate the layer to be imaged. Thus, regardless of how high the beam intensity, no image will be developed when the beam energy is too low to penetrate the imaging layer selected It is particularly preferred that at least the higher beam energy, required for the underlying second layer, be effected by energy transmitted from an electron beam; however, the beam energy used for both layers can be effected with the same particulate energy source, if desired. Although it is preferable to effect development of the second imaging layer before imaging the surface layer, the order of exposure may be reversed without departing from the scope of this invention.

The radiant energy contemplated as the energy source in the present invention includes energy generated from an electron beam such as developed by cathode ray guns, ion beams, uncharged particle beams such as molecular beams, gamma rays and X-rays used in radiography, beta rays, electron corona discharge, ultra-violet and actinic radiation, radiation from visible and infra-red regions of the electro magnetic spectrum and other forms of corpuscular and/or wave-like energy generally deemed to be radiant energy.

The preferred source of exposure employed in the present invention is an electron beam. Generally the electrons, under high vacuum, between about $10^{-3}$ and about $10^{-9}$ torr, preferably between about $10^{-5}$ and about $10^{-8}$ torr, at the modulated beam energy required to penetrate and image the selected imaging layer, bombard the halogenated polymeric binder causing generation of hydrogen halide and simultaneous interaction of the triphenyl methane dye precursor with the hydrogen halide to form its corresponding halide salt dye for color development at the point of electron impact. The techniques of electron beam recording are well known, thus further amplification is not required. However, for illustrative purposes, a conventional electron beam recording operation suitable for the present invention may utilize an electron beam characterized by having a beam diameter of from about 1 to about 100 micrometers, a current flow of from about $10^{-9}$ to $10^{-5}$ amps and adapted to scan a target area at a rate such that the dwell time is from about $10^{-8}$ to $10^{-3}$ seconds. Vacuum pressures in the film chamber commonly range from about $10^{-3}$ to $10^{-8}$ torr.

Generally, an exposure can be effected by any radiant source including photons, UV light, X-rays, gamma rays, beta rays, an ion beam, a molecular beam of uncharged particles, and an electron beam; electron beam being the preferred energy source. Exposures for both imaging layers are usually carried out at dosage levels between about $10^{-8}$ C/cm$^2$ and about $10^{-2}$ C/cm$^2$, preferably between about $10^{-6}$ C/cm$^2$ and about $10^{-3}$ C/cm$^2$, for electron beam exposure or the equivalent dosage for other sources of radiation. For example, UV light less than 3,000 A wavelength is similar in its effect to an electron beam of the above range for the purposes of this invention.

The normally solid, halogenated polymers selected for the imaging layers in the present invention function as binders for the polyphenylmethane dye precursor and corresponding dyes in a homogeneous distribution throughout the layer. These polymers contain between about 10 and about 90 wt. %, preferably between about 40 and about 70 wt. %, of labile halogen and are selected from the group of aliphatic polymers such as for example, polyvinyl halide, polyvinylidene halide and their copolymers containing a minor amount, preferably less than 25%, of comonomers such as, trichloroethylene, dichlorodifluoroethylene, vinyl acetate or lower alkyl acrylate or methacrylate comonomers. The halide moiety of the polymers can be chlorine, bromine or iodine; however, the chlorine containing polymers are preferred and polyvinyl chloride and polyvinylidene chloride homopolymers or vinyl chloride/vinylidene chloride copolymers are most preferred. Generally, it is also preferred that the same polymeric binder be employed for both imaging layers, but different binders having dissimilar reactivity constants, can be selected for special adaptations of this invention.

The polyphenylmethane compounds of this invention represent a restricted class of leuco base compounds which have the capability of reacting with hydrogen halide to form an ionized halide salt dye, preferably the chloride salt dye. In general, these phenylmethane compounds are represented by the formula

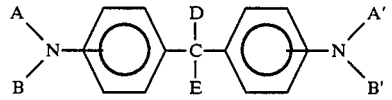

wherein A, B, A' and B' are independently hydrogen or lower alkyl and alternatively A taken with B and N or A' taken with B' and N can form a 4–6 membered heterocyclic ring; D is hydrogen or hydroxy and E is hydrogen, phenyl or naphthyl which aryl radicals may be unsubstituted or substituted with

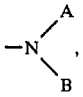

chlorine, bromine, lower alkyl or mixtures of these substituents or D and E, taken together, represent an imino group directly bonded to the carbon atom as =NA.

Examples of such polyphenylmethane dye precursors, preferably diphenylmethane and triphenylmethane precursors, together with their corresponding halide salt dyes are presented in the following Table.

TABLE I

| leuco base precursor | halide salt dye |
|---|---|
| $[(CH_3)_2N—C_6H_4]_2—CH—(C_6H_5)$ leuco malachite green or $[(CH_3)_2N—C_6H_4]_2—C(OH)—(C_6H_5)$ leuco malachite green carbinol* | 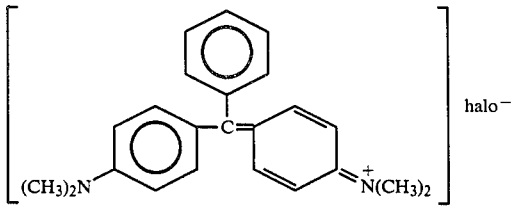 Malachite Green |

TABLE I-continued

| leuco base precursor | halide salt dye |
|---|---|
| $[H_2N—C_6H_4]_2—CH—(C_6H_5)$<br>p,p'-bis(aminophenyl)phenylmethane | 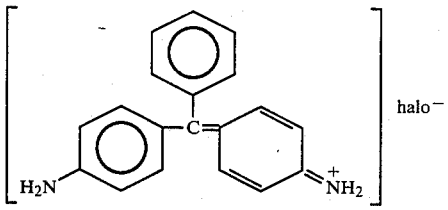 <br>Doebner's Violet |
| 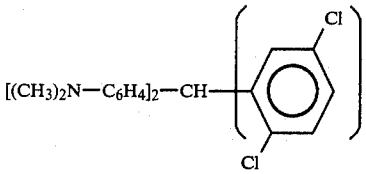 <br>1,4-dichlorophenyl-p,p'-bis(N,N'—dimethylaminophenyl)methane | 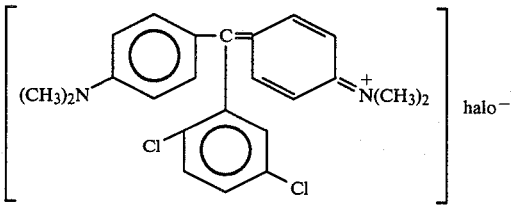 <br>Victoria green |
| $(H_2N—C_6H_4)_3—CH$<br>p,p',p''-tris(aminophenyl)methane<br>or<br>$(H_2N—C_6H_4)_3—C—OH$<br>p,p',p''-tris(aminophenyl)carbinol | 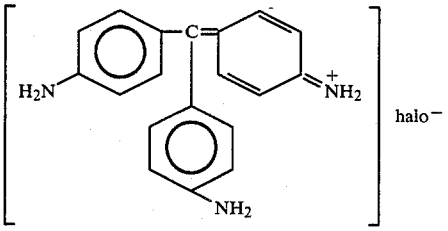 <br>Pararosaniline |
| 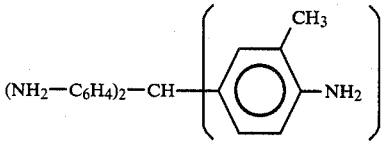 <br>p,p'-bis(aminophenyl)3-methyl-4-aminophenyl methane | 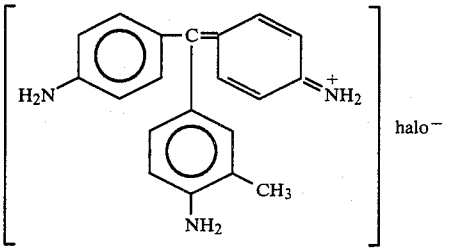 <br>Fuchsine |
| $[(CH_3)_2N—C_6H_4]_3—CH$<br>p,p',p''-tris(N,N'—dimethylaminophenyl)methane<br>or<br>$[(CH_3)_2N—C_6H_4]_3—C—OH$<br>p,p',p''-tris(N,N'-dimethylaminophenyl)carbinol | 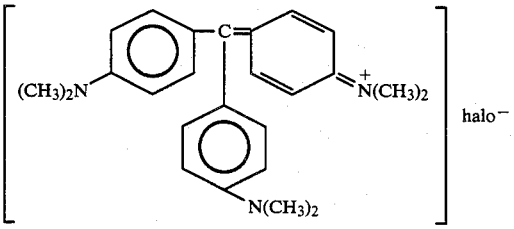 <br>Crystal Violet |

TABLE I-continued

| leuco base precursor | halide salt dye |
|---|---|
| 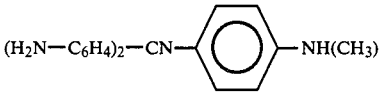 p,p'-bis(aminophenyl)-p-(N—methylaminophenyl)methane | 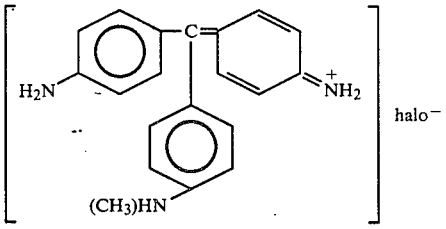 halo⁻ Methyl violet |
| 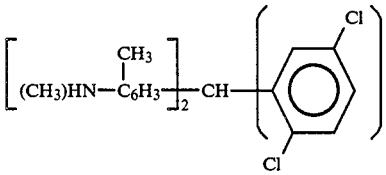 p-aminophenyl-1,4-dichlorophenyl-[2-methyl-3-(N—methylamino) phenyl]methane | 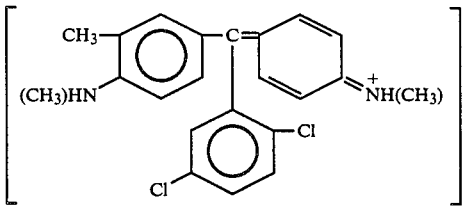 halo⁻ Glacier Blue |
| $[(CH_3)_2N—C_6H_4]_2CH(C_6H_4Cl)$ 2-chlorophenyl-p,p'-bis(N,N—dimethylaminophenyl)methane | 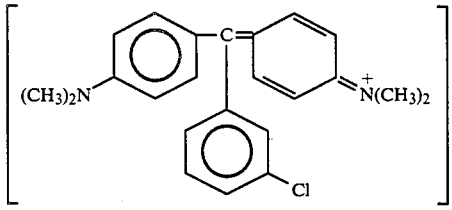 halo⁻ Setoglaucin O |
| $[(CH_3)_2N—C_6H_4]_2C=NH$ p,p'-bis(N,N'—dimethylaminophenyl)imine | 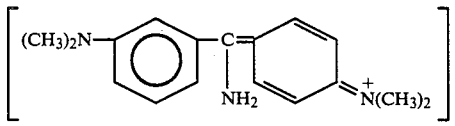 halo⁻ auramine O |
| 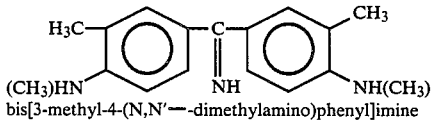 bis[3-methyl-4-(N,N'—-dimethylamino)phenyl]imine | 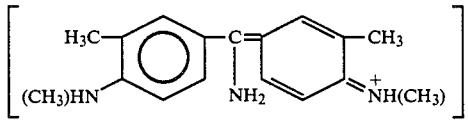 halo⁻ auramine G |
| 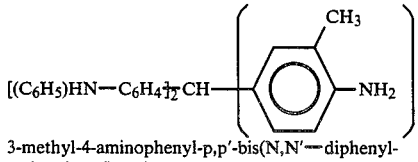 3-methyl-4-aminophenyl-p,p'-bis(N,N'—diphenyl-aminophenyl)methane | 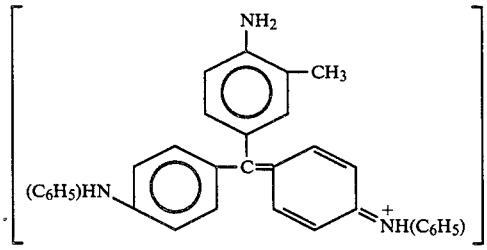 halo⁻ aniline blue |

*p,p'-bis(N,N'—diaminophenyl)phenyl carbinol

It is to be understood that mixtures of the above leuco base compounds can be employed in the first and/or any successive underlying imaging layer of this invention.

The visual color response of the present film is essentially instantaneous with radiant beam impingement and provides stable color imaging of the transmitted information in visual form. The colors developed by the dyes in the respective imaging layers remain separate and distinct in discrete exposed areas, although the image visually transmitted from the second layer is represented by a blending of the colors developed in the first and second layers taken together. However, a beam energy which selectively exposes only the first imaging layer at an address point other than that of an underlying imaging layer, transmits a visual image in the unaltered color of the halide dye contained in the first imaging layer. Also, the distinguishable colors developed in the respective layers will, of course, vary with the dyes selected.

Prior processes have employed activators such as carbon tetrachloride, carbon tetrabromide, chloroform and bromoform to provide the acid necessary for conversion of the leuco base compound to the corresponding dye. However, such activators are volatile and are therefore undesirable in a vacuum environment. More specifically they poison the cathode and interfere with accurate beam address.

A particular advantage of the present system is that no hydrogen halide in excess of that which can be instantly consumed by the dye precursor is generated. Thus, problems associated with volatile activators are obviated. For best results in accordance with the teachings of this invention, precursors for the individual imaging layers are selected to provide proper contrast and blending of tones to present a visually attractive and easily discernable image in the developed film.

The selected dye precursors uniformly distributed throughout the binder layers are incorporated at a concentration between about 1 and about 25 wt. %, preferably between about 5 and about 15 wt. %.

The coating solutions which form the imaging layers are prepared by dissolving the dye precursor compound in an inert solvent or mixture of solvents, including acetone, methyl ethyl ketone, methyl isobutyl ketone, dioxane, ethanol, butanol, dichloromethane, cyclohexanone, tetrahydrofuran, carbon tetrachloride, cellosolve, methyl cellosolve, toluene, dichlorobenzene etc., and mixing the resulting solution with a solution of the halogenated polymeric binder in any of the foregoing inert solvents or mixtures of solvents. Coating solutions prepared in this manner are then individually coated in successive layers on the electrically conductive substrate and dried at a temperature between about 15° C. and about 125° C. under atmospheric pressure for a period of from about 10 seconds to about 5 hours. Taken together, the first and second imaging layers describe a lamina having a thickness of between about 1 and about 15 micrometers disposed on the conductive substrate. In certain cases, e.g. where a thin surface layer is employed, a somewhat thicker second layer, e.g. between about 4 and about 8 micrometers, is recommended. The resulting film is placed in a specimen holder below the source of radiant energy for exposure and color development of the image or pattern to be transmitted.

For the purposes of the present invention, it is preferred to employ a multilayered substrate for the image receiving layers. The substrate essentially contains an electrically conductive layer underlying the imaging layers and a non-conductive support. However, in certain applications, where the imaging layers have sufficient integrity at exposure temperatures, the film may consist solely of the imaging layers or the imaging layers and an electrically conductive layer.

Supports suitable for the purposes of the present invention include any of those commercially available and generally include an electrically conductive layer of between about 0.001 micrometer and about 0.25 micrometer thickness, preferably 0.01 micrometer and about 0.05 micrometer thickness.

Although transparent conductive layers of up to about 0.05 micrometers are useful, opaque conductive layers of up to 5 micrometers can also be employed when need arises. The conductive layer limits the capacitance of the charge accepting layer, namely the image-receptive layers, and typically has a resistivity of $10^6$ ohms/square or less, and preferably $10^4$ ohms/square or less. The conductive material is an electrically conductive metal, metal oxide, metal alloy, metal halide or carbon black which metal, metal compound and carbon black components may or may not be suspended in a dispersion medium such as gelatin, dextran, a cellulose ether or ester or any other conventional suspension medium. Suitable metals include gold, silver, platinum, copper, iron, tin, aluminum, indium, nickel, palladium, rhodium and mixtures of these as may occur in alloys and metal oxides or halides. A specific metal oxide which may be suitably employed includes indium-tin oxide. Silver bromide and copper iodide are representative of the metal halides which may be used as the conductive layer. Of these conductive materials, a indium-tin oxide or gold coated polyester film of 2–8 mils thickness is most preferred.

When desired, the imaging layers may be more firmly affixed to each other or to the conductive layer by means of a thin adhesive layer having a thickness of between about 0.1 micrometer and 1.5 micrometers. When used, suitable adhesives include acrylate based polymers and copolymers, particularly those containing carboxylate moieties such as acrylic acid or methacrylic acid residues and mixtures of these polymers or copolymers with gelatin; although usually adhesive agents are not required.

In certain cases, when a conductive metal sheet is employed as the substrate, a separate non-conductive layer may be eliminated and the image-receptive layer disposed on the metal sheet as the sole support.

When supported, the conductive layer is superimposed on a substrate of between about 0.25 and about 100 mils, preferably 0.5 to 10 mils thickness. Suitable materials employed as non-conductive substrates include polyester, polyethylene terephthalate, glass, clay-sized paper, fiberboard, metal sheeting, glazed ceramic, cellulose acetate, polystyrene, polycarbonates or any other conventional support.

The substrate or support can be flexible or rigid, opaque or transparent depending on the final use of the film. Particularly, preferred are glass and the commercial polyester substrates such as MYLAR (polyethylene terephthalate), supplied by E. I. duPont Corporation and HOSTAPAN supplied by American Hoechst.

Having generally described the invention, reference is now had to the examples which describe preferred embodiments thereof, but which are not to be construed as limiting to the scope of the invention as more broadly set forth above and in the appended claims.

EXAMPLE 1

A solution was made containing 26.6 g of polyvinylchloride dissolved in 200 ml of tetrahydrofuran. To 70 ml of this solution was added 1 g of the leuco base, malachite green carbinol, dissolved in 5 ml of dichloromethane and the resultant mixture was intimately blended and then coated with a wire-wound rod onto a 4 mil polyester film base having a transparent electrically conductive gold coating. The resulting composite was dried at 115° C. for 30 seconds to provide a film having an imagable surface layer approximately 5 micrometers in thickness. This film was designated as Sample A.

EXAMPLE 2

A solution was made containing 10% by weight of polyvinylchloride in tetrahydrofuran. To 50 ml of this solution was added 0.8 g of the leuco base, p,p',p''-tris(N,N'-dimethylaminophenyl)carbinol, dissolved in 10 ml of acetone. The resulting mixture was intimately blended and was then coated with a wire-wound rod onto a 4 mil polyester film base having a transparent, electrically conductive indium-tin oxide coating. The resulting composite was dried for 30 seconds at 115° C. to provide a film having an imagable surface layer approximately 6 micrometers in thickness. This film was designated as Sample B.

EXAMPLE 3

A solution was made containing 2.5 g of polyvinylchloride, 0.3 g of the leuco base, p,p',p''-tris(aminophenyl)carbinol, 50 g of tetrahydrofuran and 10 mil of acetone. This solution was intimately mixed and was then coated with a wire-wound rod to a thickness of 2 micrometers over the imaging layer of the film of Sample A and dried at 115° C. for 45 seconds to provide a film having two distinct contiguously disposed imaging layers with the p,p',p''-tris(aminophenyl)methane containing layer as the surface layer. This film was designated as Sample C.

EXAMPLE 4

A solution was prepared containing 2 g of polyvinylchloride, 0.3 g of auramine base and 50 g of tetrahydrofuran. The solution was intimately mixed and was then coated to a thickness of 2 micrometers with a wire-wound rod over the imaging layer of the film of Sample B and dried at 115° C. for 45 seconds, to provide a film having 2 distinct contiguously disposed imaging layers with the auramine base containing layer as the surface layer. This film was designated as Sample D.

EXAMPLE 5

In a recording device, a portion of the surface imaging layer of the film of Sample C containing the leuco base, p,p',p''-tris(aminophenyl)carbinol, was imaged with the alphabet using a beam of 15 KeV electrons at an exposure dosage of $10^{-5}$ coulombs/cm$^2$ for a period of 45 seconds. The image transmitted to the surface imaging layer of the film, was sharply resolved in the deep rose color of pararosaniline chloride dye developed by the leuco base compound. The underlying imaging layer of Sample C containing the leuco base, malachite green carbinol, was imaged in a separate area of the film with a series of arabic numerals (0–9) using a beam of 20 KeV and a similar exposure dosage for 45 seconds. The numeral image was transmitted to the underlying imaging layer of the film in a sharply resolved form, but in the contrasting greenish-brown color of malachite green developed by the leuco base compound, malachite green carbinol. The colors of the two distinctive images, i.e. the alphabet characters and the arabic numerals, were clearly distinguished in a visually attractive format.

EXAMPLE 6

In a recording device, a portion of the underlying second imaging layer of the film of Sample D containing the leuco base, p,p',p''-tris(N,N'-dimethylaminophenyl)carbinol was imaged with a line drawing using a beam of 20 KeV electrons at an exposure dosage of $5\times10^{-6}$ coulombs/cm$^2$ for a period of 45 seconds. The drawing, transmitted in high resolution in the deep blue color of crystal violet developed by the leuco base compound was then annotated with a printed legend by exposing in appropriate, separate areas the surface imaging layer containing the leuco base auramine using a beam of 15 KeV electrons at an exposure dosage of $10^{-5}$ coulombs/cm$^2$ for a period of 45 seconds. The annotations were transmitted to the surface imaging layer of the film in clearly resolved greenish-yellow color of auramine 0 developed by the corresponding leuco base and the overall image was transcribed in a visually attractive format.

It will be understood that many modifications and alterations in the foregoing examples will become apparent from the disclosure. For example, any of the other charged particle beam sources can be substituted in the examples for the electron beam when employed at dosage levels equivalent in effect to the electron beam dosage levels recited above.

It is also within the scope of this invention to employ a recording film comprising a conductive material supporting three or more individual and superimposed imaging layers, each composed of a binder containing a dissimilar leuco base dye precursor compound capable of distinguishable hue or color development and to image said imaging layers employing separate and distinct beam energies, each modulated to penetrate the individual imaging layers. Particularly desired of these is such a recording film having three separate superimposed imaging layers, each containing a different polyphenylmethane dye precursor compound, which are developed individually to display portions of the transmitted information in a plurality of distinguishable colors. In this case, progressively increasing beam energies within the above range, e.g. 5–50 Kev, are used for each imaging layer successively disposed beneath the surface layer. In this way, the net exposure of the film is minimized. In a broad sense, a plurality of such superimposed layers, each containing a distinctive polyphenylmethane dye precursor compound, may be regarded as forming a composite surface layer of the present recording film.

These and many more modifications which become evident from the foregoing disclosure are also included within the scope of this invention.

What is claimed is:

1. An image receptive film capable of multicolor development by energy transmitted by a source of radiant energy which comprises:

(a) a first surface imaging layer containing a normally solid, halogenated aliphatic polymeric binder capable of dehydrohalogenation upon transmission of energy from a radiant energy source at a point of impact and a first polyphenylmethane dye precursor compound homogeneously dispersed throughout said halogenated aliphatic polymer which interacts with hydrogen halide to form the corresponding halide salt dye;

(b) a second imaging layer contiguously disposed below said first layer and containing a normally solid, halogenated aliphatic polymeric binder capable of dehydrohalogenation upon transmission of energy from a radiant energy source at a point of impact and a second, distinct polyphenylmethane dye precursor compound homogeneously dispersed throughout the halogenated aliphatic polymer in said second imaging layer, which interacts with hydrogen halide to form the corresponding halide salt dye of a color distinguishable from the color of the halide salt dye of said first imaging layer and (c) a conductive support for said first and second imaging layers.

2. The film of claim 1 wherein the same halogenated aliphatic polymer is employed for said first and second imaging layers.

3. The film of claim 1 wherein at least one of the polyphenylmethane dye precursor compounds is a triphenylmethane dye precursor.

4. The film of claim 1 wherein at least one of the polyphenylmethane dye precursor compounds is a diphenylmethane dye precursor.

5. The film of claim 1 wherein said radiant energy source is an electron beam.

6. The film of claim 1 wherein the concentration of said first and second polyphenylmethane dye precursor compounds in their respective halogenated aliphatic polymer layers is between about 1 wt. % and about 25 wt. %.

7. The film of claim 1 wherein the concentration of said first and second polyphenylmethane compounds in their respective halogenated aliphatic polymer layers is between about 5 wt. % and about 15 wt. %.

8. The film of claim 1 wherein said first and second polyphenylmethane dye precursor compounds are dissimilar and are defined by the formula

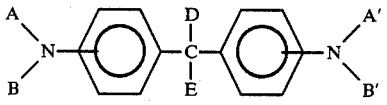

wherein A, B, A′ and B′ are independently hydrogen or lower alkyl and wherein alternatively A taken with B and N or A′ taken with B′ and N form a 4–6 membered heterocyclic ring; D is hydrogen or hydroxy and E is hydrogen, phenyl or naphthyl which aryl radicals are unsubstituted or substituted with

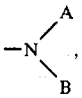

chlorine, bromine, lower alkyl or mixtures of said substituents or wherein D and E, taken together, define an amine radical, =NA, doubly bonded to carbon.

9. The film of claim 8 wherein at least one of the first and second polyphenylmethane dye precursor compounds is a mixture of dissimilar polyphenylmethane dye precursor compounds.

10. The film of claim 8 wherein one of the polyphenylmethane dye precursor compounds is p,p′,p″-tris(aminophenyl)carbinol which is convertible to the halide salt dye pararosaniline.

11. The film of claim 8 wherein one of the polyphenylmethane dye precursor compounds is p,p′-bis(N,N′-dimethylaminophenyl)phenyl carbinol which is convertible to the halide salt dye malachite green.

12. The film of claim 8 wherein one of the polyphenylmethane dye precursor compounds is p,p′,p″-tris(N,N′-dimethylaminophenyl)carbinol which is convertible to crystal violet.

13. The film of claim 8 wherein one of the polyphenylmethane dye precursors is p,p′-bis(N,N′-dimethylaminophenyl)imine which is convertible to auramine O.

14. The process for developing the film of claim 1 by exposure to a source of radiant energy for multicolor development of an image which comprises: exposing said film at least twice, once to a beam energy and dosage sufficient to penetrate and generate hydrogen halide from said halogenated aliphatic polymer in said first imaging layer and once to a higher beam energy at a dosage sufficient to penetrate and generate hydrogen halide from said halogenated aliphatic polymer in said first and second imaging layers.

15. The process of claim 14 wherein the source of radiant energy is an electron beam and wherein said film is exposed at least once at a beam energy of between about 5 KeV and about 20 KeV at a dosage of from about $1\times10^{-8}$ to about $1\times10^{-2}$ C/cm$^2$ and at least once at a higher beam energy of between about 20 KeV and about 50 KeV at a dosage of from about $1\times10^{-8}$ to about $1\times10^{-2}$ C/cm$^2$.

16. The process of claim 14 wherein the exposure to the higher beam energy precedes exposure to the lower beam energy.

17. The process of claim 14 wherein the exposure to the higher beam energy follows exposure to the lower beam energy.

18. The process of claim 15 wherein one exposure is at a beam energy of between about 10 KeV and about 15 KeV and one exposure is at a beam energy of between about 20 KeV and about 30 KeV.

* * * * *